US009682466B2

(12) United States Patent
Wessel

(10) Patent No.: US 9,682,466 B2
(45) Date of Patent: Jun. 20, 2017

(54) RING LIGHT

(71) Applicant: Elmer A. Wessel, Lincoln, NE (US)

(72) Inventor: Elmer A. Wessel, Lincoln, NE (US)

( * ) Notice: Subject to any disclaimer, the term of this patent is extended or adjusted under 35 U.S.C. 154(b) by 69 days.

(21) Appl. No.: 14/849,878

(22) Filed: Sep. 10, 2015

(65) Prior Publication Data

US 2016/0069548 A1 Mar. 10, 2016

Related U.S. Application Data

(60) Provisional application No. 62/048,499, filed on Sep. 10, 2014.

(51) Int. Cl.

| | |
|---|---|
| ***B25B 23/18*** | (2006.01) |
| ***F21S 9/02*** | (2006.01) |
| ***F21V 21/096*** | (2006.01) |
| *F21W 131/403* | (2006.01) |
| *F21Y 103/33* | (2016.01) |
| *F21Y 115/10* | (2016.01) |

(52) U.S. Cl.

CPC ..... *B25B 23/18* (2013.01); *F21S 9/02* (2013.01); *F21V 21/096* (2013.01); *F21W 2131/403* (2013.01); *F21Y 2103/33* (2016.08); *F21Y 2115/10* (2016.08)

(58) Field of Classification Search

CPC ..... F21Y 2101/00; F21Y 2103/33; F21W 2131/403; B25B 23/18; F21V 21/096; F21S 9/02

See application file for complete search history.

(56) References Cited

U.S. PATENT DOCUMENTS

| | | | | |
|---|---|---|---|---|
| 2,259,910 | A | 10/1941 | Rylsky | |
| 2,515,437 | A | 7/1950 | Bisch et al. | |
| 3,474,242 | A | 10/1969 | Forrant | |
| 4,085,436 | A | 4/1978 | Weiss | |
| 4,423,470 | A | 12/1983 | Naito et al. | |
| 4,729,070 | A | 3/1988 | Chiu | |
| 5,473,519 | A | 12/1995 | McCallops et al. | |
| 6,663,260 | B1 * | 12/2003 | Tieszen | G01N 21/8806 362/249.02 |
| 7,461,961 | B2 | 12/2008 | Li | |
| 8,224,175 | B2 | 7/2012 | Yang | |
| 8,317,350 | B2 | 11/2012 | Friedman et al. | |

* cited by examiner

*Primary Examiner* — David V Bruce

(74) *Attorney, Agent, or Firm* — Dobbin IP Law; Geoffrey E. Dobbin

(57) ABSTRACT

A ring light is provided for rotary, spindle based machines such as mills and drills. The ring light is magnetically held to the machine about the spindle and may be moved along the spindle to any location thereon. The ring light may powered by a module containing batteries which may be replaceable or chargeable by a power supply or through induction. All three embodiments are disclosed. The construction is generally unitary with respect to the ring portion of the ring light and it may be constructed so that the power module is removable or as one piece with the ring portion.

17 Claims, 6 Drawing Sheets

RING LIGHT

CROSS-REFERENCES TO RELATED APPLICATIONS

This Application claims priority on prior filed U.S. Provisional Application No. 62/048,499, filed Sep. 10, 2014, and incorporates the same by reference herein in its entirety.

FIELD OF THE INVENTION

The present invention relates to the field of lighting and more particularly relates to a work light mountable unto a tool with a rotatable spindle.

BACKGROUND OF THE INVENTION

Lighting is a serious concern in the manufacturing industry. When products are handmade, it is incumbent upon the operator to be able to see what he or she is doing. Often, however, the machines they use, in and of themselves, create shadows which obscure the work that needs to be done. To this end, many work lights have been developed for many different types of machines. These may be hard-mounted upon the machine or may be "soft-mounted," which is to say removable. One particular solution is described in U.S. Pat. No. 6,663,260 to Tieszen. It this patent, a ring light is described for a rotary, spindle-type tool. The light features a soft-mounting support ring and a replaceable light ring, thus allowing for different light ring modules to be positioned on the support ring. However, the support ring travels with the spindle of the tool and is, at all time, near the chuck. Some operators may want adjustability as to where their light actually is placed, especially given that close proximity to the chuck is also close proximity to the work in progress, risking damage to the ring light from flack. The disclosed ring light is also powered by a cord, which does add some limitation to its use.

A ring light for a rotary, spindle-type tool which mounts around the spindle of the machine in question, thereby allowing variation in its location would be but one embodiment of the invention. It may or may not be also cordless and may have a modular power supply option.

The present invention represents a departure from the prior art in that the ring light of the present invention allows for adjustment of the location of the ring light and presents selectable options to power the same. Unlike the prior art, the light ring is a unitary construction, requiring no separate support structure.

SUMMARY OF THE INVENTION

In view of the foregoing disadvantages inherent in the known types of ring lights, this invention provides a unitary and adjustable ring light. As such, the present invention's general purpose is to provide a new and improved ring light that is unitary in the support and functional structures, cordless or corded, and is adjustable in its location on the machine with which it is being used.

To accomplish these objectives, a ring light may comprise a magnetic ring of LED lights of sufficient diameter to fit around and abut a given spindle of a machine, such as a milling machine, drill, or grinder. Magnets may be positioned about the inner circumference of the ring, thus providing both vertical and radial magnetic attraction. By positioning the mill light on the frame of the machine, about the spindle, the light may remain at that location on the machine while the spindle moves. As it is unobstructed, the ring light may be vertically moved about the spindle and the radial attraction of the magnets will hold it in place. The ring light may also be made cordless, powered by batteries which may be charged by either a standard charging cord or an induction charging system. The power supply may be made modular to the remainder of the ring light or as a whole.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the ring light is herein described. It should be noted that the articles "a", "an", and "the", as used in this specification, include plural referents unless the content clearly dictates otherwise.

Figure 1:
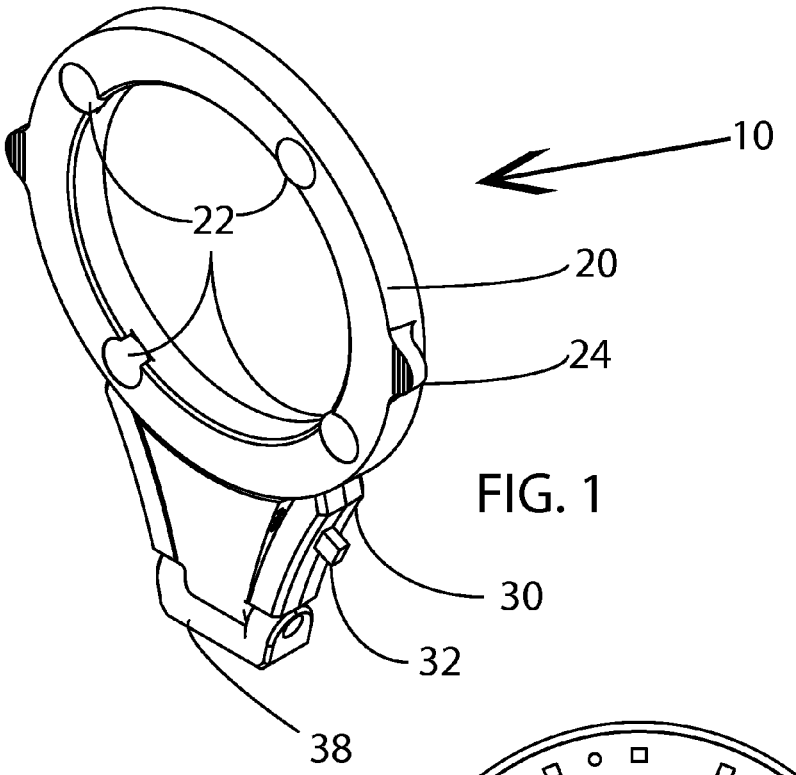
FIG. 1 is a perspective view of a ring light according to one embodiment of the present invention.
Figure 2:
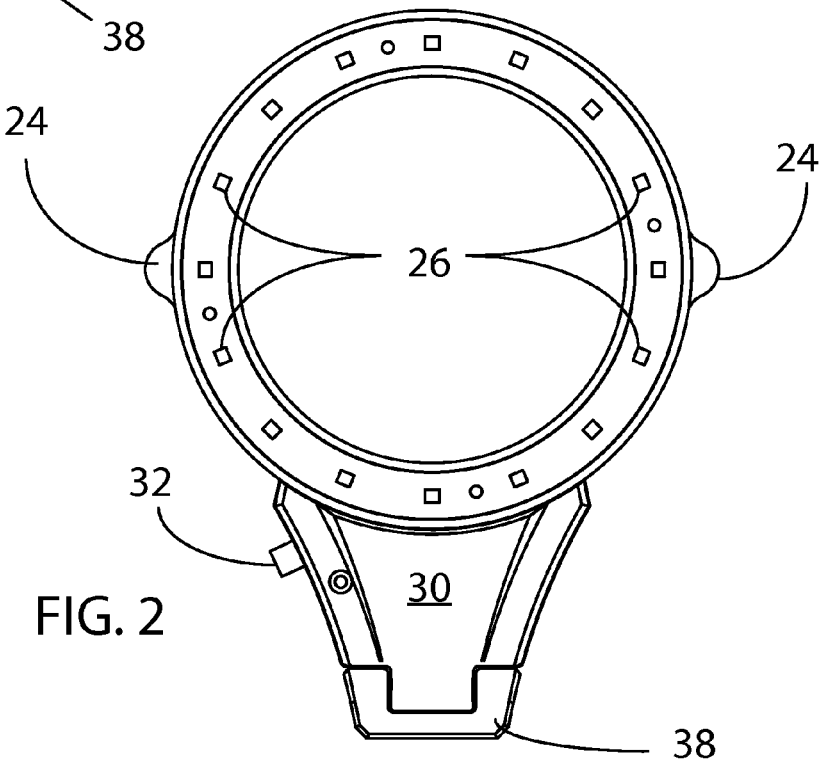
FIG. 2 is a bottom plan view of the ring light of FIG. 1.
Figure 3:
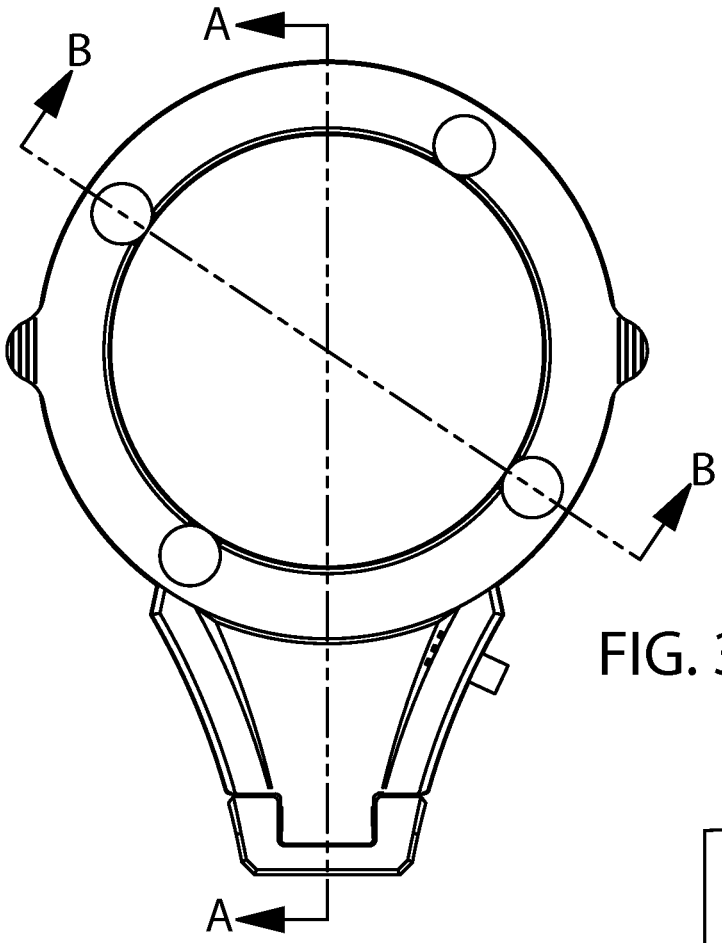
FIG. 3 is a top plan view of the ring light of FIG. 1.
Figure 8:
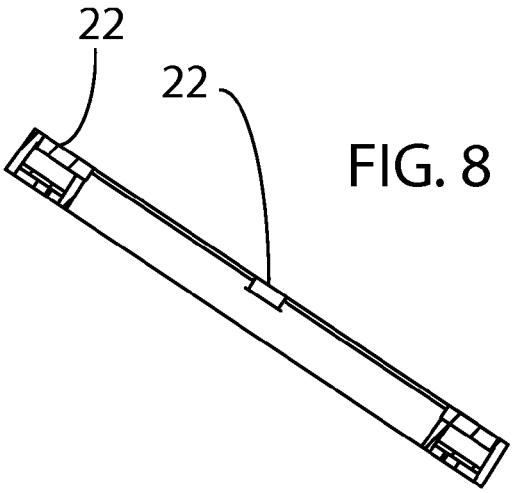
FIG. 8 is a sectional view of the ring light of FIG. 3, taken along line B-B.
Figure 9:
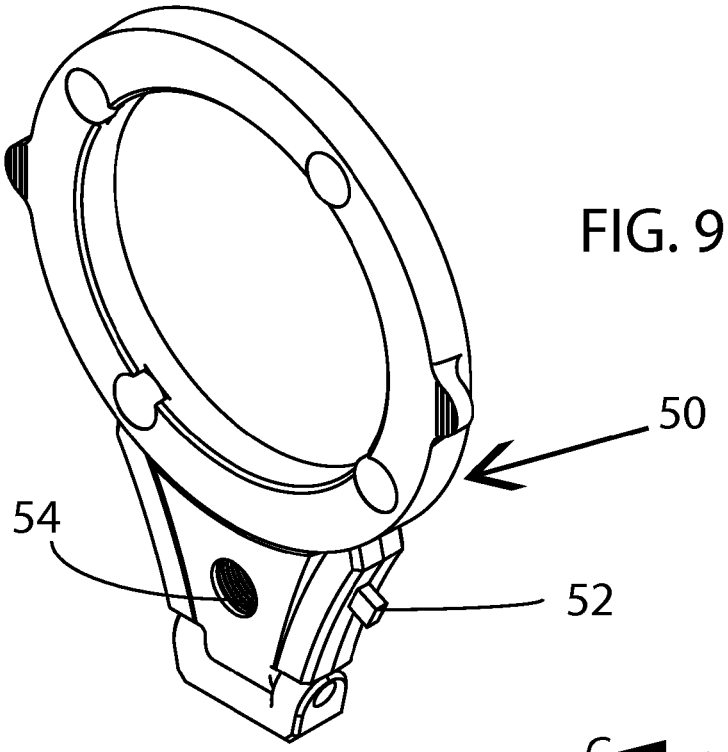
FIG. 9 is perspective view an alternate embodiment of a ring light according to the present invention.
Figure 10:
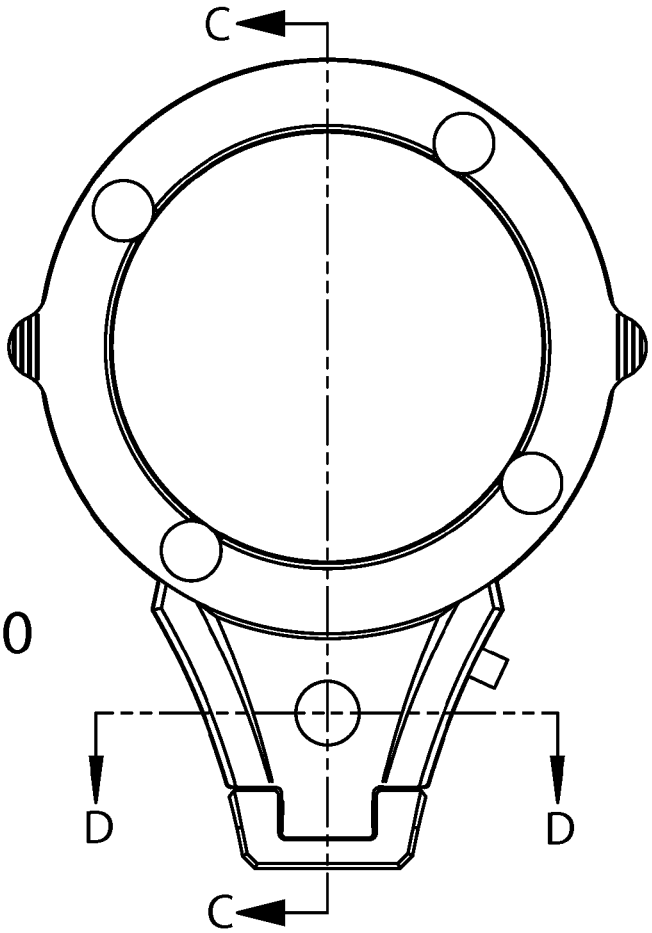
FIG. 10 is a top plan view of the ring light of FIG. 9.
Figure 11:
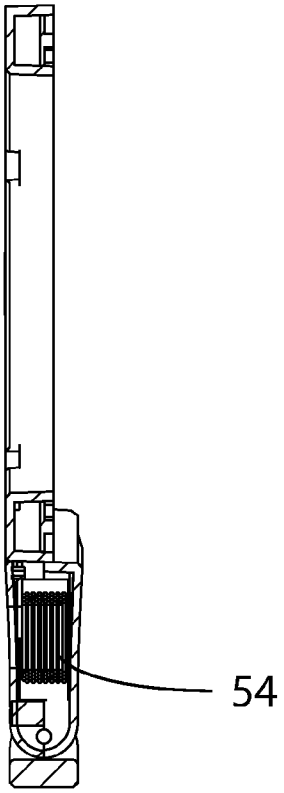
FIG. 11 is a sectional view of the ring light of FIG. 10, taken along line C-C.
Figure 12:
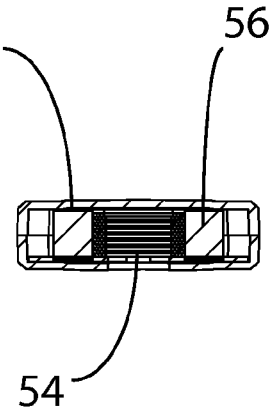
FIG. 12 is a sectional view of the ring light of FIG. 10, taken along line D-D.

With reference to FIG. 1, the ring light 10 features a flat, ring-shaped bracket, or lighting ring, 20 and a power module 30. The module 30 and lighting ring 20 may be fused together or may be made removable from each other. Both are within the purview of this invention. On the top side of the lighting ring are a plurality of magnets 22. These magnets 22 are positioned along the inner circumference of the lighting ring, even to the point of being exposed along their edges (FIG. 8). On the bottom side, shown in FIG. 2, the lighting ring 20 contains a plurality of LEDs 26 about the ring so as to generate an evenly distributed field of light for the user. Number and type of LEDs will be dependent upon the size of the ring light and other factors determined by the manufacturer. Generally speaking, the LEDs 26 are best mounted upon a board 28 shaped to fit the lighting ring 20. The lighting ring 20 is defined generally, and may take any suitable shape. The depicted shape is a ring with two opposing handles 24 with which to engage the light ring 10 for adjustment purposes. However, any suitable shape may be utilized.

Figure 4:
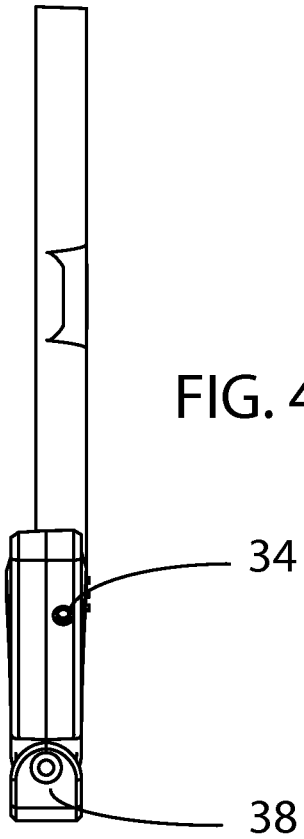
FIG. 4 is a left elevation of the ring light of FIG. 1.
Figure 5:
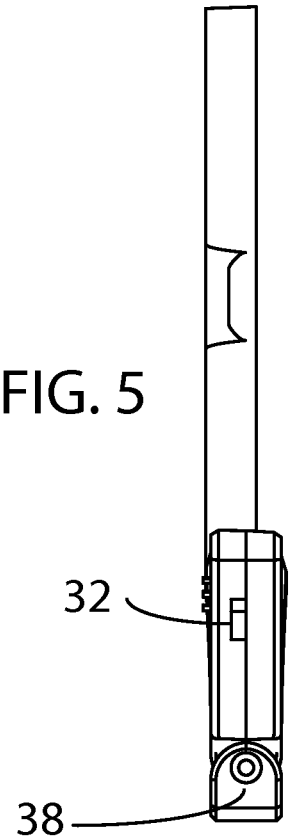
FIG. 5 is a right elevation of the ring light of FIG. 1.
Figure 6:
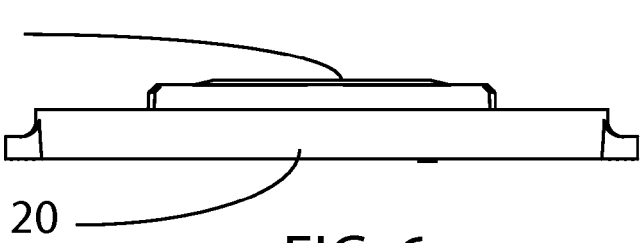
FIG. 6 is a front elevation of the ring light of FIG. 1.
Figure 7:
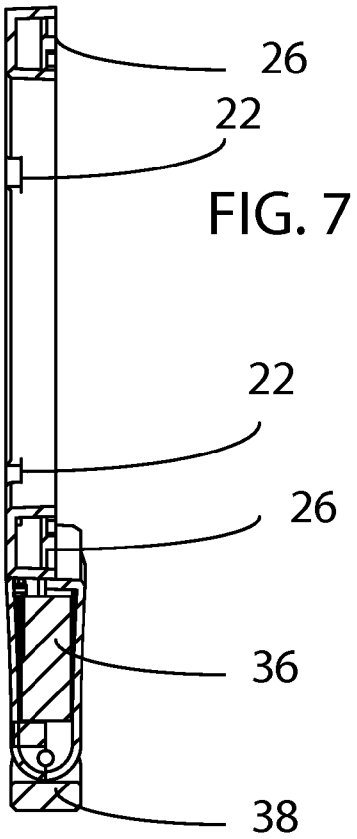
FIG. 7 is a sectional view of the ring light of FIG. 3, taken along line A-A.

Power module 30 features a switch 32 (FIG. 5) and may feature a charging port 34 (FIG. 4). Charging port 34 may be for an AC, DC, USB, or any other power supply known or later developed. As can be seen in FIG. 6, power module 30 is slightly thicker than lighting ring 20 in order to accommodate its contained components; however, there is no requirement that this be so as components may become smaller in coming years or the lighting ring 20 may be made thicker. The power module contains at least one rechargeable battery 36 which stores power from the charging system and provides it for the LEDs 24. It should, of course, be understood that a regular, replaceable, battery may be used instead of a rechargeable battery and the charging port 34 may then be eliminated.

Figure 13:
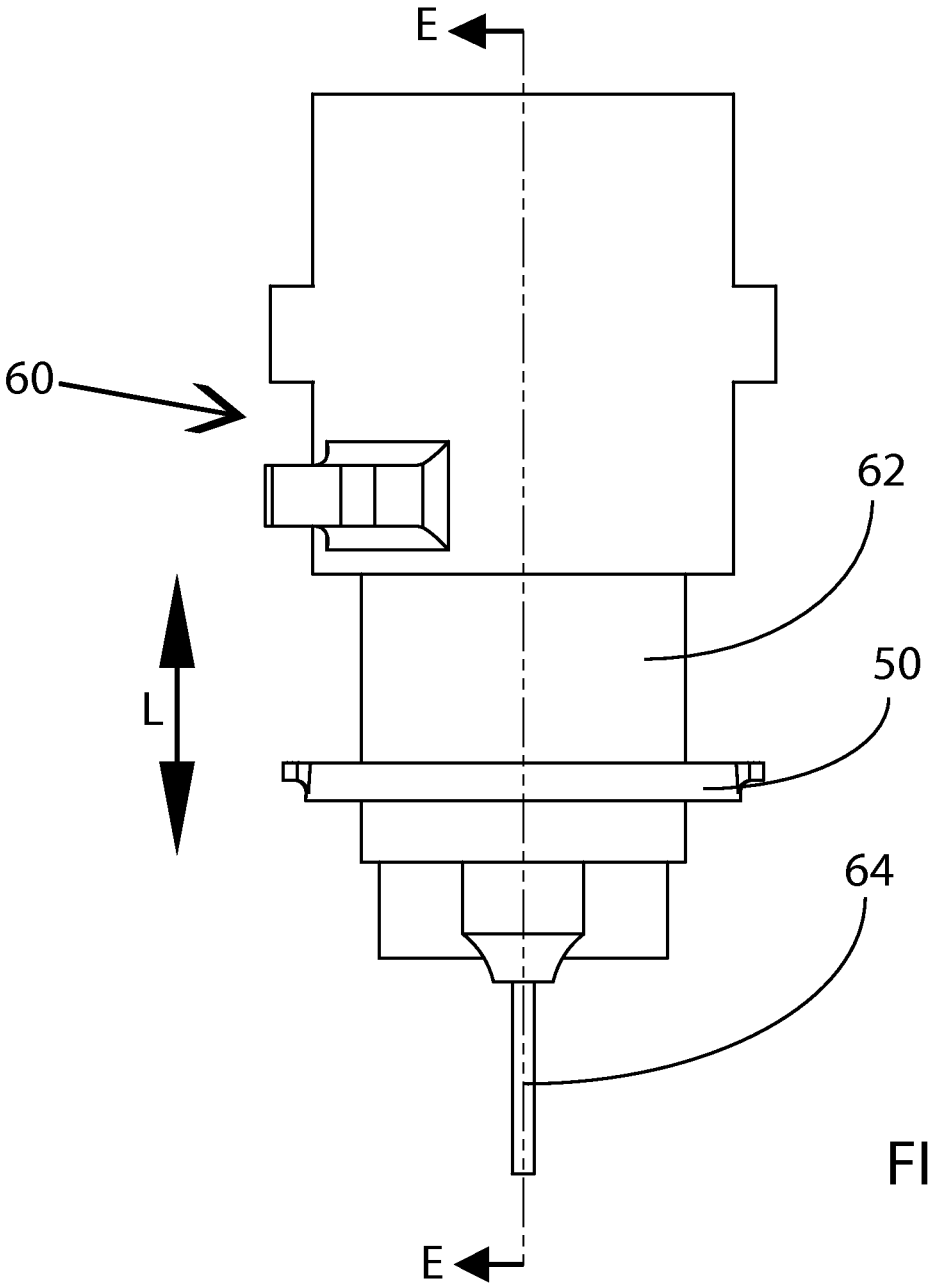
FIG. 13 is a front elevation of a machine with the ring light of FIG. 9 installed.

In an alternate embodiment, an induction charging system is added to the power module 52, as shown in FIGS. 9-14. The lighting ring 20 is the same as the previous described embodiments. However, an induction port 54 is located in the power module 50. In this embodiment, at least one battery 56 may be utilized to store power. Induction port 54 is manufactured to interact with a charging unit 58 that may mounted on a machine 60 as shown in FIG. 13 or may be located elsewhere. The depicted embodiment features a female port in the power module 52 and a male interface with the charging unit. It is entirely conceivable to reverse this relationship or to simply make a charging dock for the ring light. A port 54 may also be unnecessary as induction will charge a battery merely in close proximity to the induction system. As such, the ring light, either with or without a port 54, may be readily manufactured for charging in a dock. For convenience, such a dock may be manufactured to mount on the machine 60 or be located in any convenient location.

Figure 14:
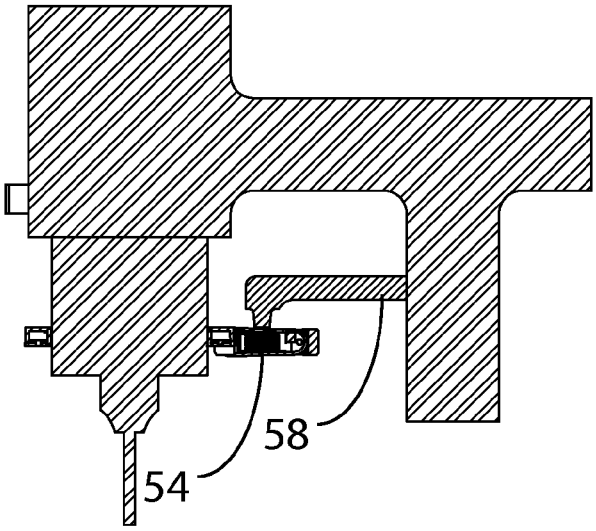
FIG. 14 is a sectional view of the machine of FIG. 13, taken along line E-E.

In use, shown in FIGS. 13-14, the ring light 50 is positioned about the spindle 62 of the machine 60. Spindle 62 may then be raised and lowered at will. The positioning of the magnets in the lighting ring create a stronger attraction vertical towards the surface of the machine frame than on the spindle 62. This keeps the ring light 50 on the frame, or, as shown in FIG. 14, magnet positioning will enable the ring light 50 to have a stronger attraction to the charging unit 68. This then keeps the ring light 50 well away from the chuck 64 and bit 66, and therefore more removed from flack ejected from the work piece. The ring light 50 may then be moved anywhere along the length L of spindle 62 as desired by the user. The ring light 50 is then held in place by the radial magnetic attraction with the spindle 62.

As the ring light is magnetically attracted to the machine 60, or any ferrous surface, storage of the ring light on the machine 60 is possible using the currently depicted magnets 22. It is readily conceivable that additional magnets may be utilized for mounting purposes. Such magnets may be positioned about the outer circumference of the ring light and even on the hinged mounting foot 38 seen in the drawings at the base of the power module 30. It is not necessary that this mounting foot 38 be hinged; it merely adds additional secondary functionality as the ring light 10 may be used in lighting situations other than its primary purpose for illuminating the work area of a machine 60.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A ring light comprising:

a. a light mounting bracket in the shape of a flat ring having two flat sides;

b. at least one means for producing light mounted on one of the flat sides of the ring;

c. at least one magnet positioned on an opposite flat side of the ring while abutting an inner circumference of said ring;

d. a power source; and e. circuitry connecting the power source and the means for producing light in an operable manner;

wherein the ring light may be mounted about a rotary spindle of a machine and the magnets will hold the ring light against a frame of the machine while the spindle may be raised and lowered and further that the ring light may then be optionally raised and lowered along the spindle.

2. The ring light of claim 1, the means for producing light being a plurality of LED's.

3. The ring light of claim 2, the power source being at least one rechargeable battery.

4. The ring light of claim 3, the power source further comprising a charging port for direct connection to an electrical battery charging apparatus.

5. The ring light of claim 3, the power source further comprising at least one component of an induction charging system, remaining components of the induction charging system being so provided for charging the rechargeable battery.

6. The ring light of claim 1, the power source being at least one rechargeable battery.

7. The ring light of claim 6, the power source further comprising a charging port for direct connection to an electrical battery charging apparatus.

8. The ring light of claim 6, the power source further comprising at least one component of an induction charging system, remaining components of the induction charging system being so provided for charging the rechargeable battery.

9. A ring light comprising:

a. a light mounting bracket in the shape of a flat ring having two flat sides;

b. at least one means for producing light mounted on one of the flat sides of the ring;

c. at least one magnet positioned on an opposite flat side of the ring;

d. a power source; and e. circuitry connecting the power source and the means for producing light in an operable manner;

wherein the ring light may be mounted about a rotary spindle of a machine and the magnets will hold the ring light circumferentially about said spindle and the ring light may also be raised and lowered along a length of said spindle.

10. The ring light of claim 9, the means for producing light being a plurality of LED's.

11. The ring light of claim 10, the power source being at least one rechargeable battery.

12. The ring light of claim 11, the power source further comprising a charging port for direct connection to an electrical battery charging apparatus.

13. The ring light of claim 11, the power source further comprising at least one component of an induction charging system, remaining components of the induction charging system being so provided for charging the rechargeable battery.

14. The ring light of claim 9, the power source being at least one rechargeable battery.

15. The ring light of claim 14, the power source further comprising a charging port for direct connection to an electrical battery charging apparatus.

16. The ring light of claim 14, the power source further comprising at least one component of an induction charging system, remaining components of the induction charging system being so provided for charging the rechargeable battery.

17. The ring light of claim 9, the magnets being situated such that they abut an inner circumference of the ring.

* * * * *